US011597483B2

(12) United States Patent
Chen

(10) Patent No.: US 11,597,483 B2
(45) Date of Patent: Mar. 7, 2023

(54) WHEEL STRUCTURE AND KAYAK USING THE SAME

(71) Applicant: NINGBO KAYAKA SPORTS CO., LTD, Ningbo (CN)

(72) Inventor: Bingrui Chen, Hangzhou (CN)

(73) Assignee: NINGBO KAYAKA SPORTS CO., LTD., Ningbo (CN)

( * ) Notice: Subject to any disclaimer, the term of this patent is extended or adjusted under 35 U.S.C. 154(b) by 0 days.

(21) Appl. No.: 16/959,361

(22) PCT Filed: Nov. 8, 2019

(86) PCT No.: PCT/CN2019/116450
§ 371 (c)(1),
(2) Date: Jun. 30, 2020

(87) PCT Pub. No.: WO2021/042506
PCT Pub. Date: Mar. 11, 2021

(65) Prior Publication Data

US 2021/0403133 A1 Dec. 30, 2021

(30) Foreign Application Priority Data

Sep. 2, 2019 (CN) ..... 201910821731.5

(51) Int. Cl.
*B63C 13/00* (2006.01)
*B63B 34/26* (2020.01)

(52) U.S. Cl.
CPC ..... *B63C 13/00* (2013.01); *B63B 34/26* (2020.02)

(58) Field of Classification Search
CPC ..... B63B 34/26; B63C 13/00
See application file for complete search history.

(56) References Cited

U.S. PATENT DOCUMENTS 2,817,538 A * 12/1957 Romang ..... A63B 55/60 280/47.26
5,560,629 A * 10/1996 Allard ..... B62D 43/02 280/475
5,575,731 A * 11/1996 Chung ..... B62M 11/10 475/307

(Continued)

*Primary Examiner* — S. Joseph Morano
*Assistant Examiner* — Jovon E Hayes
(74) *Attorney, Agent, or Firm* — Yee & Associates, P.C.

(57) ABSTRACT

The present invention discloses a wheel structure and a kayak using the same, relating to the field of ships. The wheel structure mainly comprises wheel bodies, a shaft and a support rod, wherein the connecting piece is arranged at one end of the support rod opposite to the wheel body, a bidirectional ratchet wheel mechanism is arranged between the shaft and the support rod, the bidirectional ratchet wheel mechanism can selectively control the shaft through adjustment, to make same rotate only in one direction, and then achieve the purpose of controlling the rotation direction of the wheels; the wheel structure is mounted on the kayak, when being loaded, the kayak is effortlessly pushed under the action of wheels, and the rotation direction of the wheels is limited by the bidirectional ratchet mechanism so that the wheels can only roll towards the vehicle, therefore, the pushing person does not need to powerfully offset the retreating force of the wheels, that is, it is easier and effortless to push the kayak to be loaded.

7 Claims, 6 Drawing Sheets

(56) References Cited

U.S. PATENT DOCUMENTS

| | | | | |
|---|---|---|---|---|
| 6,189,478 | B1 * | 2/2001 | Myers | B63C 13/00 114/344 |
| 7,527,013 | B2 * | 5/2009 | Bramson | B63C 13/00 114/344 |
| 7,637,223 | B2 * | 12/2009 | MacDonald | B63C 13/00 114/344 |
| 8,091,501 | B2 * | 1/2012 | Lazarevic | B63C 13/00 114/344 |
| 8,733,767 | B2 * | 5/2014 | Roberts | B62B 5/0083 280/47.331 |
| 10,479,154 | B2 * | 11/2019 | Butler | B60F 3/0092 |

* cited by examiner

WHEEL STRUCTURE AND KAYAK USING THE SAME

TECHNICAL FIELD

The present invention relates to the field of ships, particularly to a wheel structure and a kayak using the same.

BACKGROUND

With the improvement of the living standard, more and more people like the water sports, i.e. kayaking. However, in order to transport a kayak to a designated water area to enter water, there is often a need to load the kayak on a vehicle for transport. At present, it is often very difficult to push the kayak onto the vehicle roof manually when loading, and it is very expensive if the kayak is loaded by means of a professional tool, which may increase extra costs.

SUMMARY

To solve the above technical problems, an object of the present invention is to provide a wheel structure which is mounted on a kayak and is capable of achieving easy loading by pushing the kayak manually.

To achieve the above object, the present invention adopts the following technical solution: a wheel structure, mainly comprising wheel bodies, a shaft and a support rod, wherein a bidirectional ratchet wheel mechanism is arranged between the shaft and the support rod.

By adopting the above technical solution, the bidirectional ratchet wheel mechanism can selectively control the shaft through adjustment, to make same rotate only in one direction, and then achieve the purpose of controlling the rotation direction of the wheels; the wheel structure is mounted on the kayak, when loading, one end of the kayak is lifted, the other end thereof comes into contact with the ground by the wheels, and the kayak is pushed towards the vehicle and is easily pushed under the action of the wheels; however, it is not enough to rely on the wheels only, because the wheels can roll forwards or roll backwards, in the process of loading the kayak onto the vehicle roof, the weight of the kayak may affect the wheels and make same roll backwards, that is, in the process of loading the kayak onto the vehicle roof, if a pushing person releases hands, the kayak may retreat, so continuously pushing the kayak may actually need to offset the retreating force of the wheels, the bidirectional ratchet mechanism may limit the rotation direction of the wheels so that the wheels can only roll towards the vehicle; therefore, the pushing person does not need to powerfully offset the retreating force of the wheels, that is, it is easier and effortless to push the kayak to be loaded.

Preferably, the shaft is provided with a retreat preventing rod, and the retreat preventing rod is movably arranged on the shaft.

By adopting the above technical solution, the retreat preventing rod may not swing along with the rotation of the shaft because of being movably arranged on the shaft; when the kayak is pushed to be loaded, the kayak is inclined to the ground, and may not slide downwards under the action of the ratchet wheel mechanism; and one end of the retreat preventing rod comes into contact with the ground and then is abutted against the ground, further limiting the acting force of downward slide of the kayak.

Preferably, a U-shaped clip is arranged on the support rod, and the retreat preventing rod is matched with the U-shaped clip to realize limit.

By adopting the above technical solution, the retreat preventing rod is turned upwards, to be matched with the U-shaped clip on the support rod to realize limit, so that the retreat preventing rod can be prevent from falling when not in use.

Preferably, the support rod is provided with a camber.

By adopting the above technical solution, if the support rod is configured to be a straight tube, when the support rod is turned over to be parallel with the hull of the kayak, the wheel body arranged on the support rod may be fit with the hull and then may not effectively roll; while if the support rod is configured to be a bent tube, when the support rod is turned over to be parallel with the hull, the wheel may not be fit with the hull and may effectively roll. By such the configuration, the support rod may be applicable to turnover structures and has wider scope of application.

A kayak, wherein a main body of the kayak is provided with any one of the above wheel structures.

Preferably, the kayak is provided with a connecting piece, and the wheel structure is connected with the kayak by the connecting piece.

By adopting the above technical solution, the wheel structure is indirectly mounted on or demounted from the kayak, reducing the possibility of causing damages to the hull due to the fact that the wheel structure is frequently mounted on or demounted from the hull.

Preferably, the connecting piece is provided with a turnover structure, and the support rod of the wheel structure is provided with a limiting structure matched with the turnover structure to realize limit.

By adopting the above technical solution, the turnover structure on the connecting piece may make the support rod turn over to swing by taking the connecting piece as an end point, and may be perpendicular to the ground or may be parallel to the ground by swinging the support rod; and the limiting structure on the support rod is used to match with the turnover structure to realize limit, thus when the support rod is swung to a designated angle through the turnover structure, the limiting structure is operated to be matched with the turnover structure so that the turnover structure can be locked, thereby playing a role of fixing the angle of the support rod.

Preferably, the connecting piece comprises a sleeve, wherein the sleeve is provided with a plurality of positioning holes around same; and a spring pin is arranged at one end of the support rod, and the spring pin is matched with one positioning hole to realize limit.

By adopting the above technical solution, the support rod can be rotated at 360° in the sleeve after being inserted into the sleeve, to prevent same from rotating during use and keep same structurally stable, after the support rod is inserted into the sleeve, the spring pin is matched with one positioning hole in the sleeve to realize matching limit; and because the sleeve is provided with a plurality of positioning holes, the support rod may be selectively matched with one of the positioning holes to realize limit; therefore, in the process of using the wheel structure, if a user wants to change the horizontal direction of the wheel, the spring pin is retracted by pressing and the support rod is made to rotate in the sleeve by rotating the support rod, after the wheel rotates to a designated direction, the spring pin is bounced from a positioning hole in the corresponding position to realize matching limit, so that the wheel may be fixed in the direction.

Preferably, the sleeve is detachably provided with balanced buoys.

By adopting the above technical solution, the support rod of the wheel structure is removed from the sleeve and replaced with a balanced buoy, so that the replacement between the wheel structure and the balanced buoy in the process of using the kayak can be realized.

Preferably, the connecting piece is formed by mating a base with the sleeve, the base is arranged on the main body of the kayak, the sleeve is arranged at one end of the support rod, and the sleeve is detachably connected with the base.

By adopting the above technical solution, the sleeve is matched and connected with the base, the sleeve is arranged on the support rod, and the wheel structure is detachably connected with the base on the kayak through the sleeve, so that the operation may be more convenient when the user mounts or demounts the wheel structure.

Preferably, the base is mounted on the main body of the kayak by sealing screws.

By adopting the above technical solution, the sealing screws can guarantee the sealing at the mounting position to prevent water leakage, etc.

Compared with the prior art, the present invention has the advantages that: (1) the wheel structure is provided with a bidirectional ratchet wheel mechanism which can control the wheels to rotate only in one direction, so that it is easier and effortless when loading the kayak; (2) because the connecting piece is provided with a turnover structure, when the wheel structure is arranged at the stem of the kayak, there is only a need to turn over the wheel structure when the kayak enters water without demounting, so that the operation is more convenient; (3) because the connecting piece is provided with a turnover structure, when the wheel structure is arranged at the bottom of the kayak, it is made to be perpendicular or parallel to the ground by turning over the wheel structure, the altitudes of the kayak lifted by the wheel structure in two states are different, so that the inclined angle of the kayak can be changed by adjusting the turnover angle of the wheel; (4) by rotating the support rod in the sleeve and selecting a matched positioning hole, the rotation adjustment of the wheel structure in the horizontal direction can be realized; and (5) in the process of using the kayak, the replacement between the wheel structure and balanced buoy can be realized.

In the figures: 1. wheel body; 2. shaft; 210. bidirectional ratchet wheel mechanism; 220. retreat preventing rod; 221. U-shaped clip; 222. gravity block; 3. support rod; 310. spring pin; 320. handle; 321. limiting block; 4. connecting piece; 410. sleeve; 411. positioning hole; 420. base; 430. articulated sheet A; 440. articulated sheet B; 450. articulated shaft; 460. limiting groove; 470. sealing screw; 480. chute; 481. sliding block; 482. spring plunger; 5. balanced buoy; 6. kayak.

DETAILED DESCRIPTION

The present invention is further described below in detail in combination with the drawings and embodiments.

Embodiment 1

Figure 1:
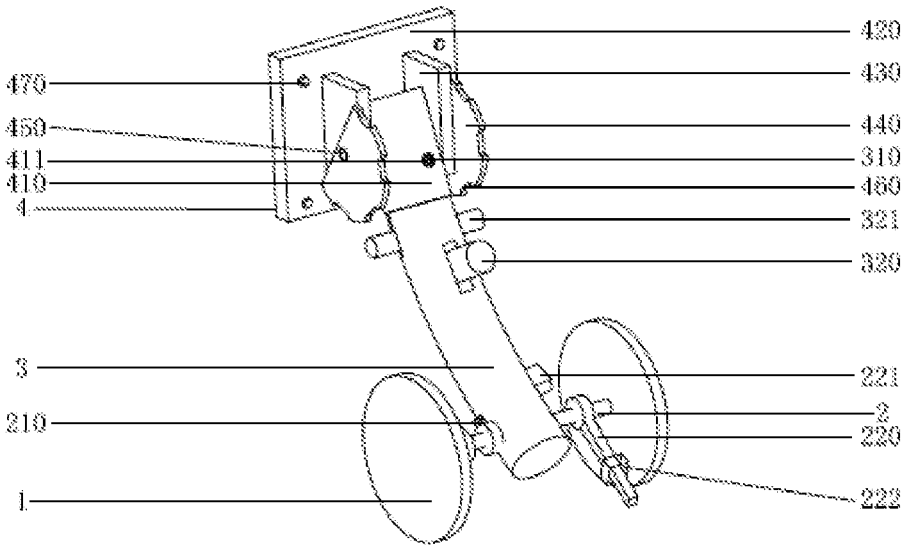
FIG. 1 is a structural schematic diagram of a wheel structure of embodiment 1 of the present invention.

A wheel structure as shown in FIG. 1, mainly comprising wheel bodies 1, a shaft 2 and a support rod 3, wherein a bidirectional ratchet wheel mechanism 210 is arranged in the connecting position between the shaft 2 and the support rod 3, a ratchet wheel of the bidirectional ratchet wheel mechanism 210 is fixed to the shaft 2, a ratchet pawl thereof and an adjustment switch for controlling the ratchet pawl are arranged on the support rod 3, under the action of the bidirectional ratchet wheel mechanism 210, the shaft 2 is adjustably rotated only in one direction, and then the wheel bodies 1 arranged at both ends of the shaft 2 are adjustably rotate only in one direction along with the shaft 2.

In this embodiment, a retreat preventing rod 220 is arranged on the shaft 2, the retreat preventing rod 220 is movably arranged on the shaft 2, that is, the retreat preventing rod is sleeved on the shaft 2 by one end, the retreat preventing rod 220 may not swing along with the rotation of the shaft 2, while in use, one end thereof is hung on either side and comes into contact with the ground, in this state, the included angle between the retreat preventing rod 220 and ground close to the side of the wheel body 1 is less than 90°, so that the retreat preventing rod 220 is abutted against the ground, the wheel body 1 cannot be rotated in the direction of the side thereof, further achieving the effect of making the wheel body 1 rotate only in one direction, that is, preventing same from retreating.

In this embodiment, a gravity block 222 is arranged at the end of the retreat preventing rod 220 coming into contact with the ground, and the gravity block 222 is used to add the weight of the end of the retreat preventing rod 220 coming into contact with the ground, so that the retreat preventing rod 220 becomes steadier when being abutted against the ground, and then is made difficult to bounce when being abutted against the ground.

Figure 2:
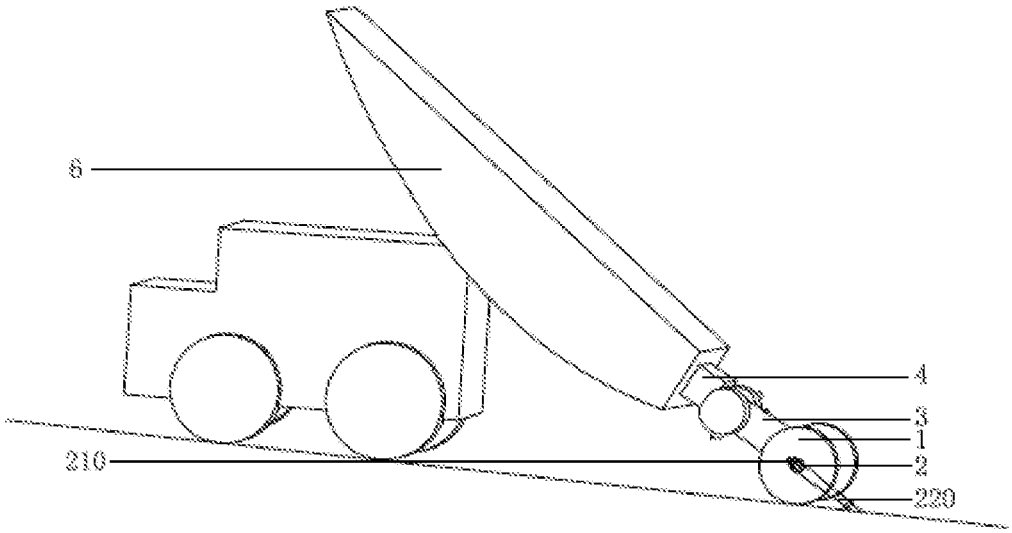
FIG. 2 is a schematic diagram showing a usage state of embodiment 1 of the present invention.

In this embodiment, a connecting piece 4 is arranged at the end of the support rod 3 of the wheel structure opposite to the wheel body 1, and the wheel structure is arranged at the stem of the kayak 6 by the connecting piece 4, as shown in FIG. 2; when the kayak 6 is loaded, the user lifts the front end of the kayak 6 to incline same, and pushes the kayak by coming into contact with the ground by the wheel structure located at the stem depending on the rotation of the wheel body 1, so that the kayak 6 is pushed more effortlessly; in the process of pushing the kayak 6 onto the vehicle roof, the bidirectional ratchet wheel mechanism 210 plays a role of locking the wheel body 1 to make same rotate only in the forward direction, thus avoiding the retreat force produced due to downward slide of the kayak 6 during loading, that is, under the cooperation of the bidirectional ratchet wheel mechanism 210, the kayak 6 is loaded easier and effortlessly; meanwhile, when the kayak 6 is pushed to be loaded, the retreat preventing rod 220 on the shaft 2 is hung on the side opposite to the vehicle, to make same come into contact with the ground to play a role of support. The principle is that: the retreat preventing rod 220 is hung to be abutted on the ground on the side opposite to the vehicle, to form an included angle less than 90° with the ground close to the side of the wheel body 1, if rotating backwards, the wheel body 1 may be stopped by the retreat preventing rod 220 and then cannot retreat, thus further playing a role of preventing the kayak 6 from retreating due to downward slide during loading.

In this embodiment, a U-shaped clip 221 is arranged on one side of the support rod 3, and the U-shaped clip is matched with the retreat preventing rod 220 to realize limit. Thus, the retreat preventing rod 220 may be hung on one side when in use, and may be turned up and snap-fitted in the bayonet of the U-shaped clip when not in use to realize snap-fitting limit, so that the use of the retreat preventing rod 220 is more controllable.

In this embodiment, the connecting piece 4 is specifically composed of a base 420, a turnover structure arranged on the base 420 and a sleeve 410 connected with the turnover structure, wherein the sleeve 410 is configured to connect with the support rod 3 and is turned over along with the turnover structure, and the base 420 is configured to connect with the hull of the kayak 6; the sleeve 410 is specifically connected with the support rod 3 in the mode that: one end of the support rod 3 is inserted from one end of the sleeve 410 to be connected with same, and because the support rod 3 is a circular tube and the inner wall of the sleeve 410 is circular, the support rod 3 is rotated at 360° in the peripheral direction in the sleeve 410 after being inserted into and matched with the sleeve; the sleeve 410 is provided with a plurality of positioning holes 411 around same, a spring pin 310 is arranged in the position opposite to the support rod 3, so that after the support rod 3 is inserted into the sleeve 410, the spring pin 310 is correspondingly bounced from one positioning hole 411 to be matched with same, thereby playing a role of limiting and fixing the support rod 3 and the sleeve 410; meanwhile, because the sleeve 410 is provided with a plurality of positioning holes 411 around same, the support rod 3 may select any one positioning hole 411 in the horizontal direction to match with same, thus when in use, the user may select a corresponding positioning hole 411 according an appropriate wheel direction to insert the support rod 3 into the positioning hole to match with same, or may rotate the support rod 3 in a state of connection with the sleeve 410, that is, the spring pin 310 is pressed to make same retract in the positioning hole 411, and the support rod 3 is rotated to make same rotate to the position of a designated positioning hole 411, and then the spring pin 310 is correspondingly bounced from the positioning hole 411 to realize matching; the support rod 3 is rotated in the horizontal direction in the sleeve 410 to select an angle for limit and fixation, so that the orientation of the wheel structure in the horizontal direction is rotatably adjusted, having higher selectivity.

In this embodiment, a turnover structure is arranged between the above-mentioned base 420 and sleeve 410, the sleeve 410 is turned over along with the turnover structure, the specific structure thereof is as follows: two articulated sheets A430 corresponding to each other are arranged on one side of the base 420, the articulated sheets A430 are connected with the base 420 in fixed position, an articulated shaft 450 is arranged throughout between the articulated sheets A430, and the articulated shaft 450 is rotated with respect to the articulated sheets A430; the sleeve 410 is located between the two articulated sheets, the side surfaces thereof are penetrated by the articulated shaft 450 and are fixedly connected with the articulated shaft 450, that is, the sleeve 410 may rotate along with the articulated shaft 450 in the same direction, thus in the case where the support rod 3 is inserted into one end of the sleeve 410 and is connected with same, by the rotation of the articulated shaft 450, the support rod 3 may be turned over along with same, thereby achieving the effect that the wheel structure makes a vertical angle, a horizontal angle, and other angles with the ground by turnover. It should be noted that each of the articulated sheets A430 has a certain width, wherein the width thereof should be such that the sleeve 410 can be rotated at 360° therebetween without coming into contact with the base 420, and both ends of the sleeve 410 can be used for the insertion of the support rod 3.

In this embodiment, two articulated sheets B440 corresponding to each other are arranged at the outer side of the articulated sheet A430, the two articulated sheets B440 are fixedly connected with the two ends of the articulated shaft 450 respectively, and the articulated sheets B440 are articulated with respect to the articulated sheets A430 under the drive of the articulated shaft 450; in this embodiment, each of the articulated sheets B440 is specifically semi-circular, it is only a preferred embodiment, and may be in other shapes, the edge of the articulated sheet B440 is provided with a plurality of limiting grooves 460; the support rod 3 is provided with a limiting structure specifically composed of limiting blocks 321, a spring and a handle 320, a set of limiting blocks 321 corresponding to each other are arranged on the side wall of the support rod 3, the end of each limiting block 321 close to the support rod 3 is located in the support rod 3, the side wall of the support rod 3 in the position corresponding to the limiting block 321 is provided with a chute, and the limiting block 321 is embedded in the chute and may slide on the support rod 3 along the chute; the spring is arranged in the support rod 3, the two ends of the spring are in the same direction as the two ends of the support rod 3, the end of the spring close to the connecting piece 4 is connected with the end of the limiting block 321 located in the support rod 3, the limiting block 321 may be jacked to the top of the chute under the action of tension of the spring, that is, the limiting block 321 in this position may be snap-fitted in the limiting groove 460 and then matched with same to realize limit, and the articulated shaft 450 may not be rotated under the action of limit, so that the purpose of matching with the turnover structure to limit is achieved; the handle 320 is arranged on one side of the support rod 3, the end of the handle 320 close to the support rod 3 is located in the support rod 3, the side wall of the support rod 3 in the position corresponding to the handle 320 is provided with a chute, the handle 320 is embedded in the chute and may slide on the support rod 3 along the chute, the end of the handle 320 in the support rod 3 is connected with the spring, the spring may be compressed by pulling the handle 320 in the direction of the wheel body 1, thereby driving the limiting block 321 to slide to the side away from the limiting groove 460. Thus, the matching limit of the limiting block 321 and the limiting groove 460 is released. When the handle 320 is released, under the action of tension of the spring, the handle 320 is automatically reset to the position before pulling, and the limiting block 321 is also reset to the position matching with the limit groove 460.

In this embodiment, the kayak is provided with the above-mentioned wheel structure, the wheel structure is arranged at the stem of the kayak 6 by the connecting piece 4, if there is a need to load the kayak 6, the user can adjust the wheel direction by pressing the spring pin 310 and rotating the support rod 3; the user can separate the limiting blocks 321 from the limiting grooves 460 on the articulated sheets B440 by pulling the handle 320 on the support rod 3, and swing the support rod 3 clockwise or anti-clockwise in the direction of rotation of the articulated shaft 450 to make same turn over to an appropriate angle, at this angle, the limiting blocks 321 correspond to the limiting grooves 460, then the handle 320 is released, so that the limiting blocks 321 are rebounded under the action of the spring and are snap-fitted in the limiting grooves 460 corresponding thereto to realize matching limit, thereby fixing the wheel structure at this angle and facilitating the loading of the kayak 6, as shown in FIG. 2; when the kayak 6 enters water, in order to make the wheel bodies 1, etc. arranged at the stem not to be immersed in water, the wheel structure can be turned over upwards in the same operation as described above, so that the wheel bodies 1 are higher than the horizontal plane and may not be immersed in water. This operation is easier than dismounting the wheel structure after entering water and then mounting same after going ashore.

In this embodiment, as shown in FIG. 1, the base 420 is provided with sealing screws 470, the base 420 is mounted on the kayak 6 by the sealing screws 470, and the sealing screws 470 can guarantee the sealing performance at the mounting position of the base 4 and the kayak 6 to prevent water leakage, etc.

In this embodiment, the support rod 3 is provided with a camber, the specific structure is as follows: the section of the support rod 3 close to the wheel body 1 is provided with a camber, the section thereof inserted into the sleeve 410 is straightly set, the reason for this setting is that: if the support rod 3 is straight on the whole, after the support rod 3 is turned over to be parallel with the hull, the wheel body 1 may come into contact with the hull, affecting the rotation of the wheel body 1. The problem can be avoided if a section of the support rod 3 is provided with a camber, and the reason that the section inserted into the sleeve 410 is set straightly is to not to affect the rotation of the support rod 3 in the sleeve 410 in the horizontal direction.

Embodiment 2

Figure 3:
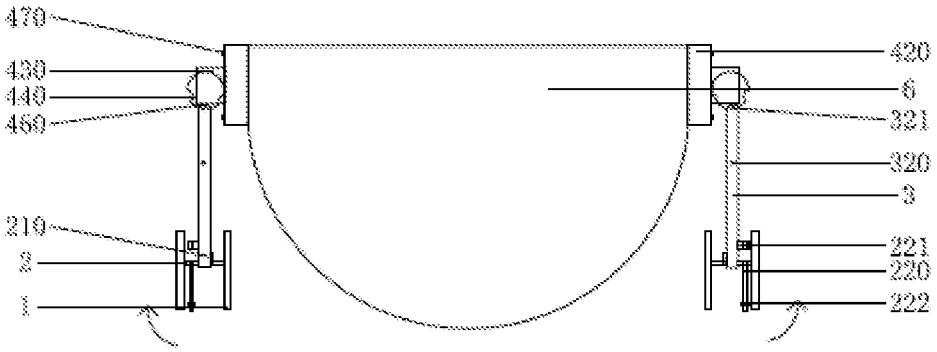
FIG. 3 is a schematic diagram showing a usage state of embodiment 2 of the present invention.

This embodiment is different from embodiment 1 in that: in this embodiment, as shown in FIG. 3, the wheel structure is arranged on both sides of the hull of the kayak 6 by the connecting piece 4, such connection mode is more suitable for the kayak 6 of which the stem has not sufficient position to connect with the base 420 but both sides of the hull have sufficient positions to connect with the base 420; the specific connection mode is that: the connecting piece 4 is arranged on both sides of the hull of the kayak 6 through the base 420, and the base 420 is mounted on the hull by the sealing screws 470; the support rod 3 of the wheel structure is inserted into one end of the sleeve 410 of the connecting piece 4, and is movably connected with the connecting piece 4 by the limit of the spring pin 310 and the positioning hole 411, so that the wheel structure is mounted on both sides of the kayak 6 by the connecting piece 4; when the user needs to move the kayak 6 on the shore, he/she only needs to turn over the wheel structure to be perpendicular to the ground in the mode in embodiment 1, and adjust the orientation of the wheel bodies 1 in the horizontal direction as needed, so that the kayak 6 can be moved on the shore through the wheel structure; after the kayak 6 enters water, the user can turn over the wheel structure in the same mode, so that the wheel bodies 1 may not be immersed in water.

Figure 4:
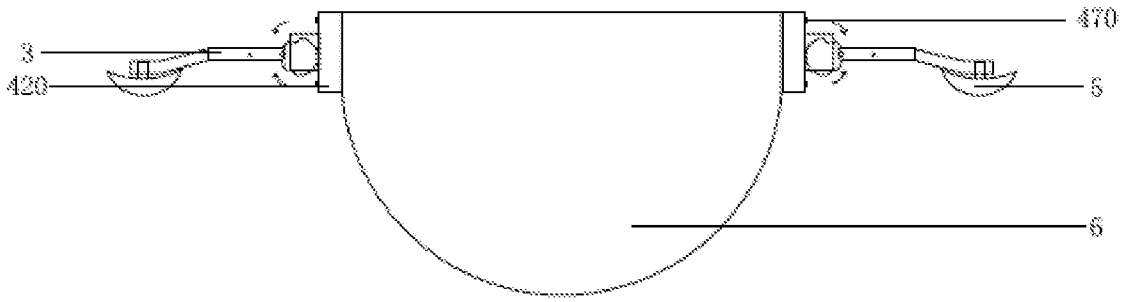
FIG. 4 is a practical schematic diagram of a balanced buoy of embodiment 2 of the present invention.

In this embodiment, the sleeve 410 of the connecting piece 4 is detachably provided with a balanced buoy 5, the support rod 3 is arranged at one end of the balanced buoy 5, the structure of the support rod 3 is identical to the wheel structure, that is, is only different from same in that a balanced buoy is arranged at other end of the support rod 3; because the wheel structure is inserted into the sleeve 410 through the support rod 3 and realizes matching limit through the spring pin 310, that is, the wheel structure and the sleeve 410 are also detachably connected, so that the user can demount the wheel structure during use and replace same with the balanced buoy 5, and turn over same to be parallel with the water surface, as shown in FIG. 4; in this way, a kayak 6 provided with balanced buoys 5 oppositely on the two sides of the hull is formed, the kayak having better balance.

Embodiment 3

Figure 5:
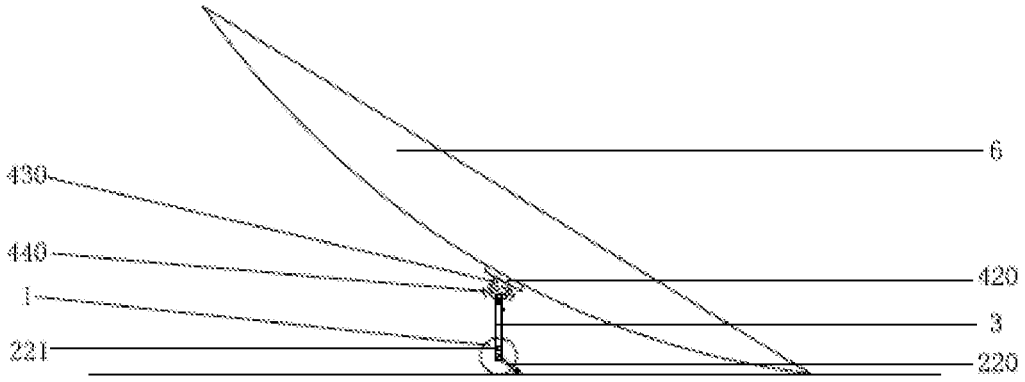
FIG. 5 is a schematic diagram showing a usage state of embodiment 3 of the present invention.

This embodiment is different from embodiment 1 in that: in this embodiment, the wheel structure is arranged at the bottom of the kayak 6 by the connecting piece 4, as shown in FIG. 5.

Embodiment 4

Figure 6:
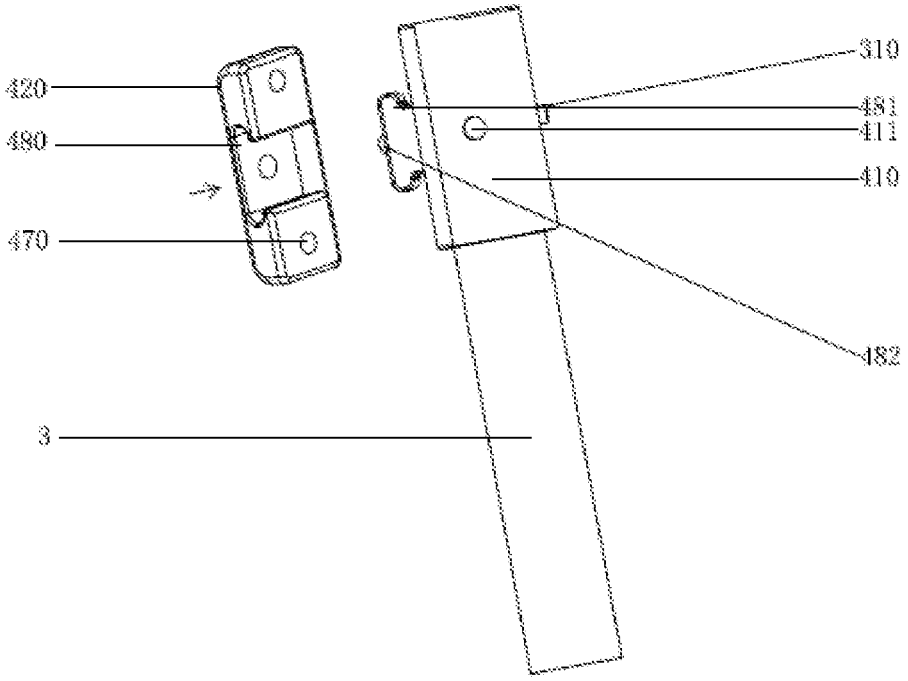
FIG. 6 is a structural schematic diagram of a connecting piece of embodiment 4 of the present invention.

This embodiment is different from embodiment 1 in that: in this embodiment, the connecting piece 4 is not provided with a turnover structure, the connecting piece 4 is composed of a base 420 and a sleeve 410, the specific structure thereof is that: a sliding block 481 horizontally arranged is arranged on one side of the sleeve 410, the base 420 is horizontally provided with a chute 480, and by the matching of the sliding block 481 and the chute 480, the sleeve 410 is detachably connected with the base 420, as shown in FIG. 6; the side surface of the sleeve 410 is provided with a plurality of positioning holes 411 in the horizontal direction, which can be matched with the spring pin 310 of the support rod 3.

The wheel structure can be arranged at both sides or stem of the kayak 6, the base 420 is mounted on the hull of the kayak 6 by the sealing screws, the sleeve 410 and the support rod 3 are in insertion matching and are fixed by the matching of the spring pin 310 and the positioning holes 411. If the user needs to demount the wheel structure from the kayak 6 or mount same on the kayak 6 during use, he/she only needs to demount or mount the sleeve 410 and the base 420, so that the operation is very simple and convenient.

In this embodiment, the sliding block 481 of the sleeve 410 is provided with a spring plunger 482, the ball head of the spring plunger 482 is arranged with respect to one side of the chute 480, and the inner wall of the chute 480 is provided with a recess correspondingly matched with the ball head of the spring plunger 482, so that when the sliding block 481 is inserted into the chute 480 and matched with same, the ball head of the spring plunger 482 may be bounced to be matched with the recess on the inner wall of the chute 480 to realize limit and fixation, thereby making the connection between the sleeve 410 and the base 420 stabler; if there is a need to separate the sleeve 410 from the base 420, because the ball head of the spring plunger 482 is spherical, the recess on the base 420 is matched therewith, and the inner wall is a curved slope surface, by applying a certain force to the sleeve 410 in the separating direction, the ball head of the spring plunger 482 is retracted by extrusion between same and the slope surface of the recess, so that the limit of the ball head and the recess is released, thereby achieving demounting.

In this embodiment, the support rod 3 is not provided with the limiting blocks 321, the handle 320 and the spring.

Although preferred embodiments of the present invention are described in detail above, it should be understood that for those skilled in the art, various variations and changes can be made to the present invention. Any modification, equivalent replacement, improvement, etc. made within the spirit and the principle of the present invention shall be included within the protection scope of the present invention.

What is claimed is:

1. A wheel structure, mainly comprising wheel bodies (1), a shaft (2) and a support rod (3), wherein a bidirectional ratchet wheel mechanism (210) is arranged between the shaft (2) and the support rod (3), wherein the shaft (2) is provided with a retreat preventing rod (220), and the retreat preventing rod (220) is movably arranged on the shaft (2) and wherein a U-shaped clip (221) is arranged on the support rod (3), and the retreat preventing rod (220) is matched with the U-shaped clip (221) to realize limit.

2. The wheel structure according to claim 1, wherein the support rod (3) is provided with a camber.

3. A kayak, wherein a main body of the kayak is provided with the wheel structures of claim 1, wherein the kayak (6) is provided with a connecting piece (4), and the wheel structure is connected with the kayak (6) by the connecting piece (4), wherein the connecting piece (4) is provided with a turnover structure, and the support rod (3) of the wheel structure is provided with a limiting structure matched with the turnover structure to realize limit.

4. The kayak according to claim 3, wherein the connecting piece (4) comprises a sleeve (410), wherein the sleeve (410) is provided with a plurality of positioning holes (411) around same; and a spring pin (310) is arranged at one end of the support rod (3), and the spring pin (310) is matched with one positioning hole (411) to realize limit.

5. The kayak according to claim 4, wherein the sleeve (410) is detachably provided with balanced buoys (5).

6. The kayak according to claim 4, wherein the sleeve (410) of the connecting piece (4) is configured to be attached to a base (420) such that the base (420) is arranged on the main body of the kayak (6), the sleeve (410) is arranged at one end of the support rod (3), and the sleeve (410) is detachably connected with the base (420).

7. The kayak according to claim 6, wherein the base (420) is mounted on the main body of the kayak (6) by sealing screws (470).

* * * * *